US005899108A

United States Patent [19]

Hofele et al.

[11] Patent Number: 5,899,108

[45] **Date of Patent: * May 4, 1999**

[54] FLEXIBLE MULTI-AXIS TRANSFER DEVICE

[75] Inventors: Hans Hofele, Goeppingen; Peter Klemm, Stuttgart; Juergen Eltze, Goeppingen; Stefan Veit, Donzdorf; Kurt Metzger, Goeppingen, all of Germany

[73] Assignee: Schuler Pressen GmbH & Co., Germany

[ * ] Notice: This patent is subject to a terminal disclaimer.

[21] Appl. No.: 08/770,709

[22] Filed: Dec. 19, 1996

[51] Int. Cl.[6] ..... B21D 43/05

[52] U.S. Cl. ..... 72/405.1; 72/405.01; 72/405.11; 198/621.1

[58] Field of Search ..... 72/405.1–405.16, 72/405.01; 414/752, 751; 198/621.3, 621.1

[56] References Cited

U.S. PATENT DOCUMENTS

| | | | |
|---|---|---|---|
| 4,487,409 | 12/1984 | Orii | 72/405.1 |
| 5,001,921 | 3/1991 | Schneider | 72/405.13 |
| 5,006,028 | 4/1991 | Jackson | 198/621.1 |
| 5,140,839 | 8/1992 | Bruns | 72/405.1 |
| 5,385,040 | 1/1995 | Michael | 72/405.1 |

FOREIGN PATENT DOCUMENTS

| | | | |
|---|---|---|---|
| 221228 | 9/1991 | Japan | 72/405.01 |
| 1433594 | 10/1988 | U.S.S.R. | 72/405.09 |

*Primary Examiner*—Daniel C. Crane
*Attorney, Agent, or Firm*—Evenson, McKeown, Edwards & Lenahan, P.L.L.C.

[57] ABSTRACT

A transfer device 41 provided particularly for multistation presses 1 has a holding device 46, 47 which is carried by several rods 53, 54, 55; 83, 84, 85 and which can be swivelled in space and positioned by means of the rods 53, 54, 55; 83, 84, 85. The rods 53, 54, 55; 83, 84, 85 are preferably connected with linear driving devices 61, 62, 63; 86, 87, 88 which therefore jointly act upon the holding device 46, 47. In the case of an embodiment having six degrees of positioning freedom, three of the rods 53, 54, 55; 83, 84, 85 are applied to a first hinge point 49 of the holding device 46, 47. By means of their other ends, these rods 83, 84, 85 define a triangle. Of the remaining three rods 53, 54, 55, two 53, 54 are applied to another hinge point 56 and a third 55 is applied to a hinge point 57 situated away therefrom which again defines a triangle together with the other two hinge points 49, 56. In addition to the simple workpiece transfer, such a transfer device 41 permits complicated positioning tasks.

10 Claims, 5 Drawing Sheets

FLEXIBLE MULTI-AXIS TRANSFER DEVICE

The invention relates to a transfer device for transporting workpieces from a work station into a machining station which follows in the machining sequence. In addition, the invention relates to a transfer system having such transfer devices and a tool machine, particularly a multistation press having such transfer devices.

The transfer system receives the workpiece, leads it to the work station which is next in the machining sequence and deposits it there. Then gripping or holding devices of the transfer system must be guided out of the work station in order not to collide with the tool acting upon the workpiece. The transfer movement to be carried out by the holding device during the transfer is a function of the concrete situations relative to the workpiece and the tool. If the multistation press or the other machining device is retooled for a new workpiece, as a rule, the transfer curve must also be adapted. Furthermore, the concrete dimensions and parameters of the workpieces to be machined are not yet determined with respect to the last detail at the point in time of the conception and/or the construction of the multistation press. It must therefore be possible to adjust the transfer curves afterwards.

As a rule, the transfer movement is a two-dimensional curve which is composed of a lifting component and of an advancing component. In addition, it may be required to swivel the workpieces about transverse axes if, for example, in a drawing station, these have a different orientation than in a press station which follows. In many cases, it is expedient to define different transfer curves between several work stations.

In order to be able to, as required, machine by means of the multistation press also workpieces which must be aligned differently about different axes in successive press stations and in the process, if possible, not to be subjected to any limitation as the result of the transfer device, a transfer device is desirable which has as many movement possibilities as possible while the number of drives is minimal. However, simultaneously, a sufficient positioning precision and a transfer speed which is as high as possible are desired in order to permit a high working speed of the multistation press.

From U.S. Pat. No. 4,887,446, a transfer system is known which is constructed as a three-axis transfer system. It includes two transfer rails which extend along the passage direction along several press stations. These are arranged on both sides of the tools. Holding devices provided on the transfer rails are used for the temporary receiving of the workpieces. The holding devices are held by a longitudinal member which is longitudinally displaceably disposed on the transfer rails and is driven in a controlled manner in the longitudinal direction by way of electric linear drives. Additional linear units are used for moving the transfer rail in the vertical lifting direction and for moving the transfer rails toward one another and away from one another (opening/closing).

This transfer device, which operates synchronously for all work stations, permits only a lifting, transporting and lowering of the workpieces. Additional positioning possibilities are not provided. In addition, the driving forces of each axis must be applied only by the drives assigned to the corresponding axis which in this case are supported on the other drives or guides of the other axial directions.

From German Patent Document DE 42 37 312 A1, a two-axis transfer system is known in which cross traverses having suction spiders are arranged between the transfer rails extending in the passage direction. The cross traverses carry out a transfer movement in whose course they are moved in the vertical direction and in the passage direction. A tilting of the workpieces about the transverse axis takes place in so-called intermediate depositing devices which are arranged between the press stations.

The intermediate depositing devices require a significant amount of space which affects the total expenditures of the press system.

From WO93/00185 a transfer system is known whose characteristics form the preamble of claim 1. The transfer system contains individual transfer devices arranged between work stations. Each transfer device leads a suction bridge, which extends transversely to the passage direction of the parts, along a programmable transfer curve. Two transfer drives respectively which hold the suction bridge at their ends are used for this purpose. Each transfer drive has an extension which extends vertically downward and which can be telescoped in the lifting direction by means of a driving unit. A lever is also disposed on the extension which can be rotated by means of a driving unit about a vertical axis and which is connected with the end of the suction bridge by way of a connecting rod.

The reaction forces which occur during the acceleration of the suction bridge in the passage or longitudinal direction must be absorbed by the vertically telescopable carrier.

In addition, shear guides and control arm guides are known from practice which have the purpose of guiding tools in space.

Based on the above, it is an object of the invention to provide a transfer device which can be used in multiple fashions.

This object is achieved by means of a transfer device according to claim 1.

In the case of the transfer device according to the invention, the holding devices, for example, suction devices, are held by a cross traverse which, in turn, on its two ends is carried and guided by a control arm gearing. The control arm gearing has control arm elements which a stressed predominantly with respect to pull or push and not or only slightly with respect to bending. They are essentially elongated, in which case a right angle bend may have to be provided for space reasons.

Both control arm gearings determine the position of the cross traverse in two directions which are radial directions with respect to the longitudinal course of the essentially oblong cross traverse. This permits a controlled parallel guiding. In addition, a control arm gearing determines the position of the cross traverse in another direction, for example, in the longitudinal direction of the cross traverse. This position may be fixedly set or may be adjustable.

The control arm elements are applied to the cross traverse such that its position is defined with respect to all degrees of freedom. If, for example, a transfer device with six degrees of freedom is involved, a total of at least six control arm elements are provided which are applied to the carrier device from three different directions and at three mutually spaced linking points or sites. By means of the driving units, which may be linked to the ends of the control arm elements disposed away from the carrier device, the control arm gearing is operated in that the control arm elements are moved individually or jointly synchronously or asynchronously. A control unit coordinates these movements such that a desired transfer curve is obtained.

The maximally six possible degrees of freedom of the holding device permit not only a translation of the workpiece but also its tilting, rotating and swivelling about all three directions in space. This provides a transfer device which permits a high measure of liberalness with respect to the design of the workpieces and tools. As the result, the transfer system is also suitable for possible complicated future tasks.

The forces affecting the cross traverse as well as its inertia forces are shared between the control arm elements and the driving units so that each driving unit must apply only a portion of the force or power required for the passage through the transfer curve. As a result, overall relatively high accelerations can be achieved which shortens the transfer times.

The transfer device may require fewer than six degrees of freedom, in which case, however, the control arm elements extend at least in two different direction away from the carrier device and support this carrier device on two linking points situated away from one another. Also in the case of such a system, the loads and forces applied to the cross traverse are shared between the control arm elements and the driving units.

The driving units are preferably each disposed in a stationary manner. As a result, each driving unit diverts the driving and guiding forces directly into a base. This results in a stiff bearing and guiding of the carrier device and thus even at high transfer speeds in a good positioning precision. The control arm elements can be constructed to be light and stiff.

The driving units are preferably linear drives whose outputs each define an axial direction. Although, in principle, these may deviate from one another, with corresponding axial directions, that is, parallel movement directions, of the individual outputs, clear geometrical conditions are achieved which facilitate the calculation of the individual control signals of the driving units by the control device.

The driving units are preferably electric drives in the case of which the rotating movement of a servomotor is converted by way of corresponding gearing devices into a linear movement or in the case of which the linear movement is generated directly by linear motors.

A simple two-axis transfer system is achieved if the control arm gearings are designed such that the position of the cross traverse is fixed with respect to its longitudinal direction and cannot be adjusted.

In the case of all above-mentioned embodiments, the driving units cooperate during the acceleration of the holding device and their effect is therefore added up. In the case of a machining device, such as a multistation press, this makes it possible to reduce the time periods required for the transfer and thus to increase the speed of the multistation press. In this case, it is also possible to let the individual press stations operate in a time-staggered manner with respect to one another so that, as the result of the phase offset between individual successive press or work stations, sufficient transfer time is obtained. Inversely, in the case of a press cycle, less time must be reserved for the transfer, whereby the speed of the multistation press can also be accelerated.

The drawing illustrates an embodiment of the invention.

SPECIFICATION

Figure 1:
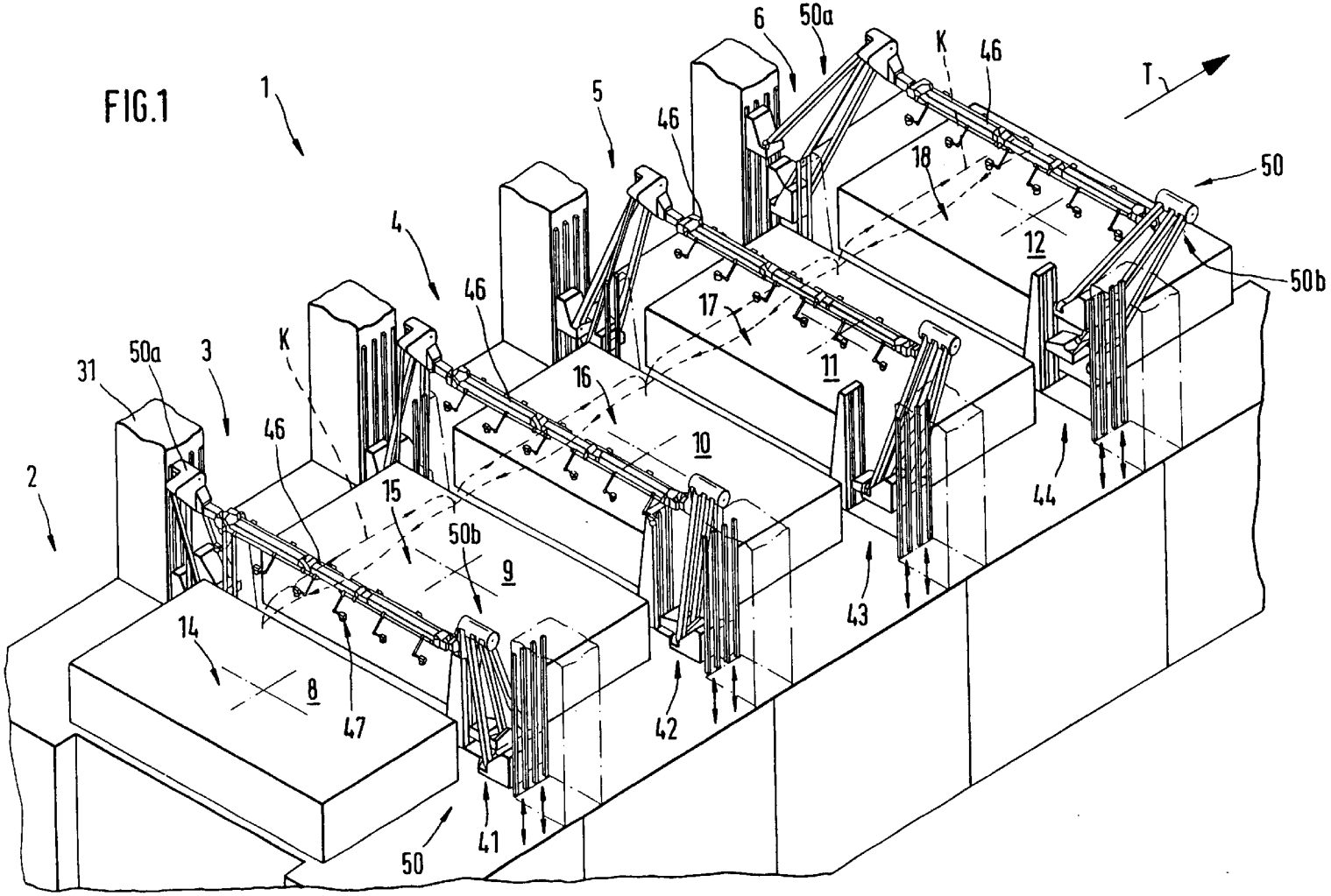
FIG. 1 is a schematic, cutout-type representation of a multistation press with transfer devices arranged between individual work stations.
Figure 2:
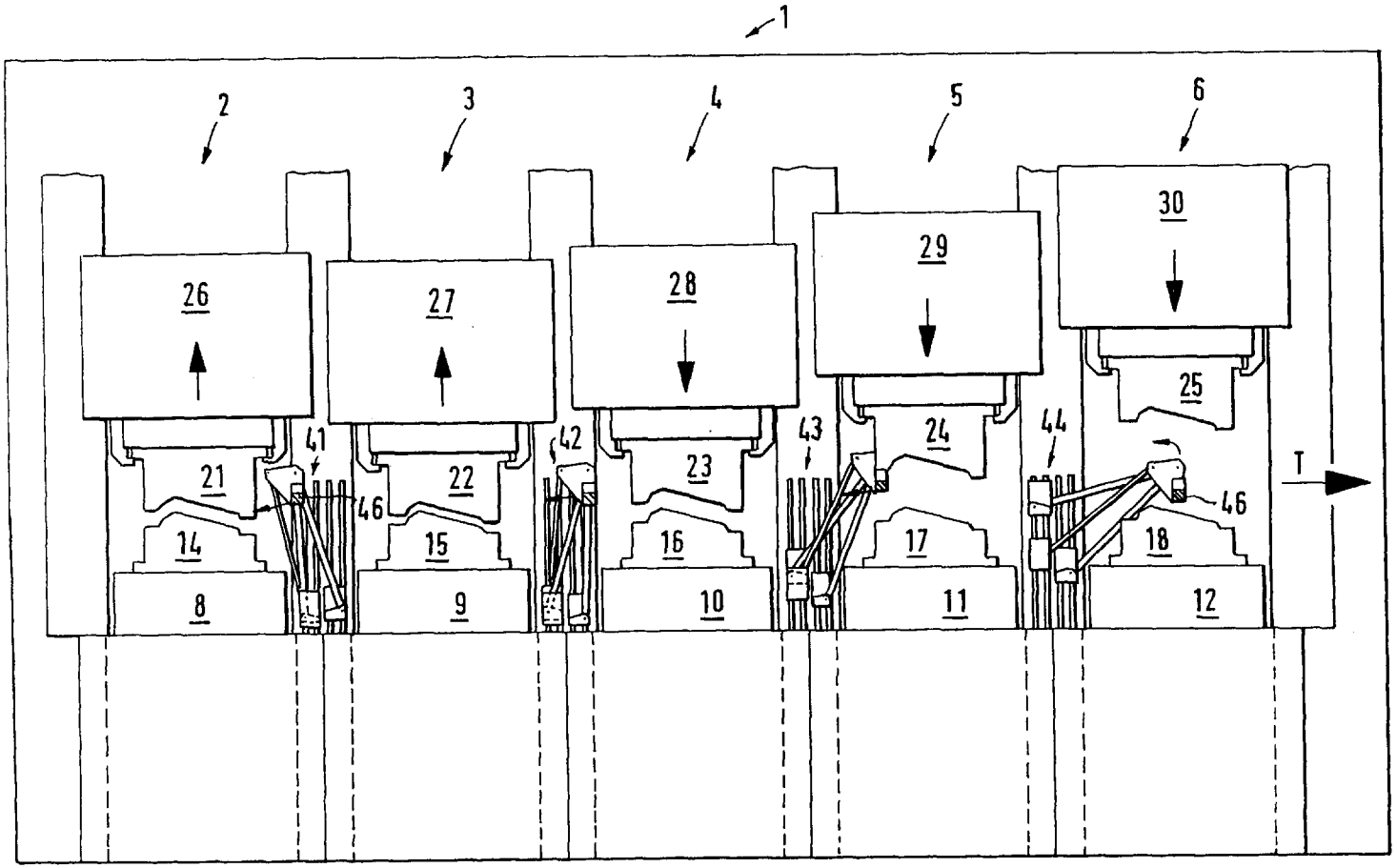
FIG. 2 is an extremely schematic lateral view of the multistation press according to FIG. 1.
Figure 3:
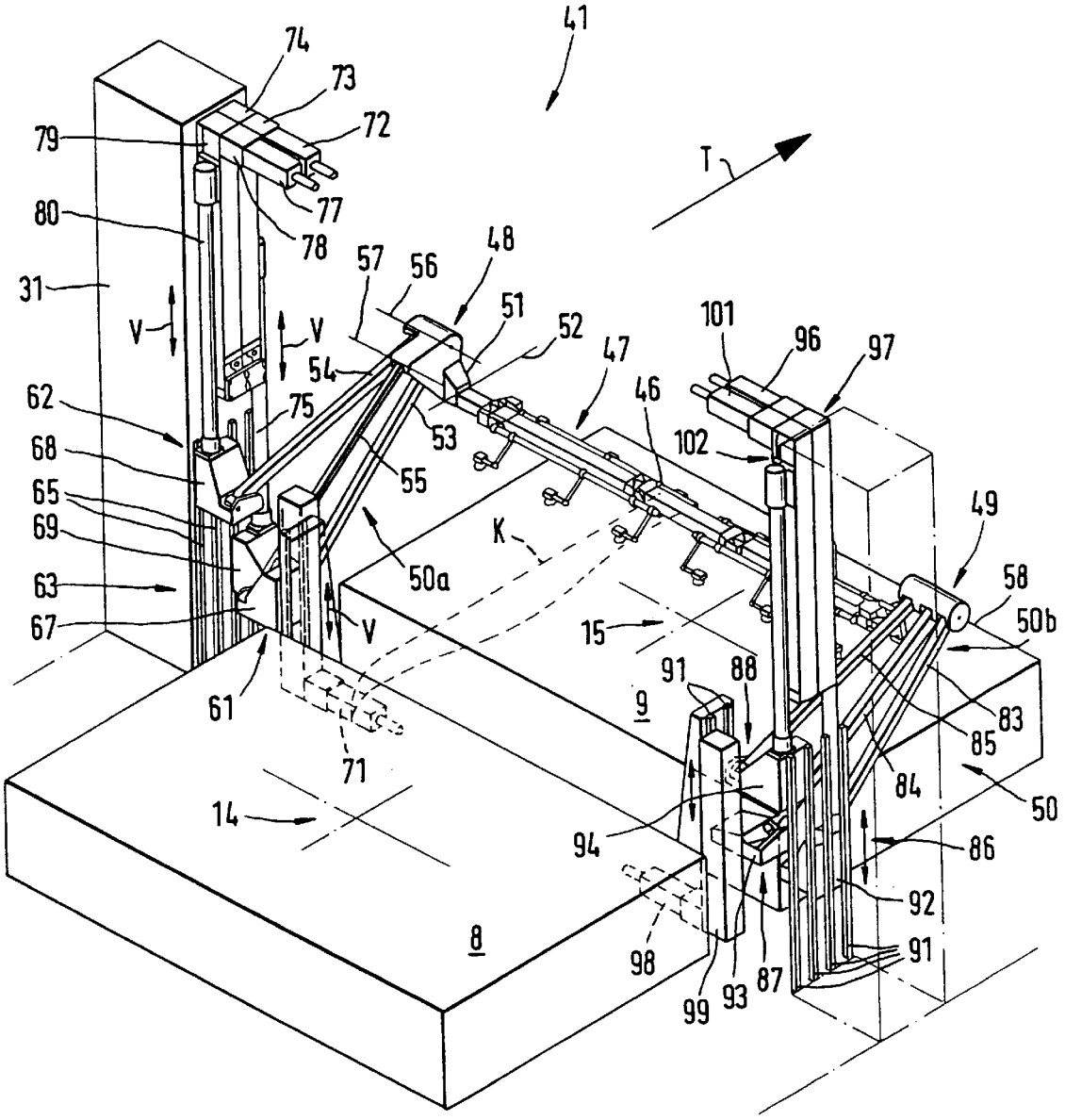
FIG. 3 is a perspective schematic view of the transfer device of the multistation press according to FIGS. 1 and 2.
Figure 4:
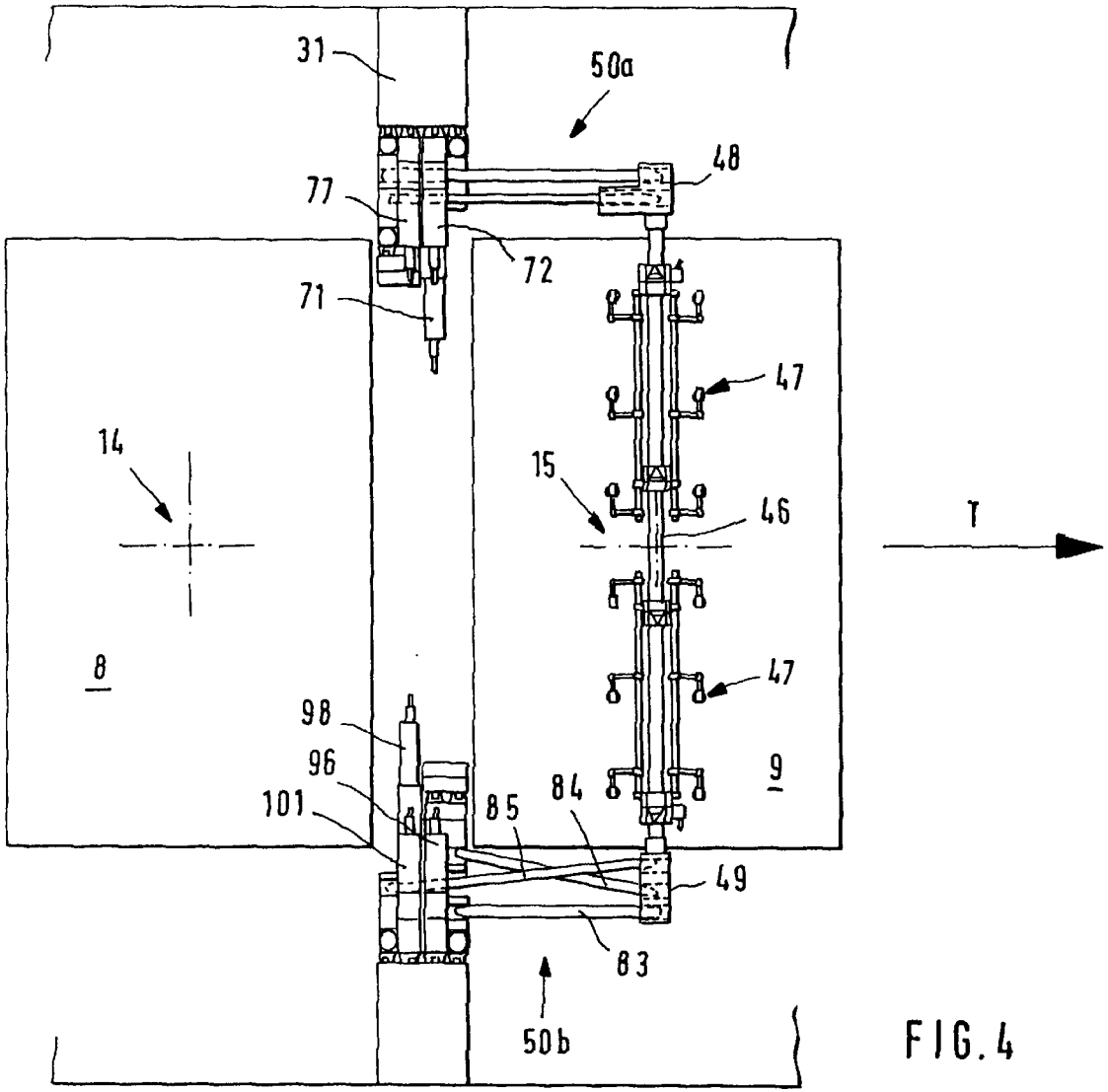
FIG. 4 is a schematic top view of the transfer device according to FIG. 3.

A multistation press 1 which is schematically illustrated in FIGS. 1 and 2 has several work or press stations 2, 3, 4, 5, 6 which are arranged behind one another and in which dies 14, 15, 16, 17, 18 are held on sliding tables 8, 9, 10, 11, 12. These dies form bottom tools to which one top tool 21, 22, 23, 24, 25 respectively is assigned. This top tool is in each case held on a slide 26, 27, 28, 29 which is moved up and down by way of an eccentric drive not shown in detail or by way of a hinge drive. The drive and the slides are supported by way of a press frame which is not shown in detail and of which a portion of a stand 31 is only illustrated schematically and as an example in FIG. 1.

The slides 26 to 30 carry out an up-and-down movement in a phase-offset manner with respect to one another. By means of the time-related and phase-related offsetting of the slide movement of adjacent slides, a better load distribution is achieved in comparison to synchronously operating slides. Required centrifugal masses can clearly be reduced and as a result the multistation press as a whole becomes lighter. In addition, an at least partial weight compensation of the slide weights is possible.

Between two adjacent work stations 2, 3; 3, 4; 4, 5; 5, 6 respectively, one transfer device 41, 42, 43, 44 respectively is arranged which transport the workpieces along a passage direction T through the multistation press 1. The transfer devices 41 to 44 have the same construction and will be described in the following by the example of transfer device 41. This transfer device 41 has a cross traverse 46 which extends transversely to the passage direction T and is to be moved along a transfer curve K. On the cross traverse, a suction spider 47 is held so that the cross traverse 45 forms a vacuum-operated holding device together with the suction spider 47.

On its two ends, the cross traverse 46 is connected with hinge units 48, 49 which are each part of a control arm gearing 50 (50*a*, 50*b*). The hinge unit 48 is connected with the cross traverse 46 by way of a hinge joint 51 whose hinge axis 52 corresponds to the passage direction T. On its other end, the cross traverse 46 is connected in a rigid or articulated manner with the hinge unit 49. The control arm gearing 50*a* determines the position of the cross traverse 46 in the passage direction T and in the vertical direction V. The control arm gearing 50*b* also determines the position of the cross traverse 46 in the passage direction T and in the vertical direction V as well as, in addition, in the transverse direction.

The hinge unit 48 is carried by a total of three control arms or rods 53, 54, 55. For this purpose, these are disposed by means of one end respectively by means of a hinge on the hinge unit 48 which permits at least one swivel movement about an axis 56 oriented transversely with respect to the passage direction T. In this case, the hinges of the rods 53, 54 have a common hinge axis 56. The rod 55 is linked to the hinge unit 48 while being spaced away from the hinge axis 56. The hinge axis 57 of the corresponding hinge is in parallel to the hinge axis 56 and spaced away from it.

By means of its end situated away from the hinge unit 48, each rod 53, 54, 55 is in each case connected with a vertically oriented linear driving unit 61, 62, 63. The linear driving units 61, 62, 63 each have a carriage 67, 68, 69 which is guided on guide rails 65 in the vertical direction and which is connected with the corresponding rod 53, 54, 55 by means of a hinge defining at least one transverse axis.

For driving the carriage 67, a servo motor 71 is used whose rotating movement is converted by means of a gearing device not shown in detail, such as a toothed belt, a spindle-type lifting gear, a toothed rack or the like, into a linear movement and is transmitted to the carriage 61. Correspondingly, the carriage 69 is driven by a servo motor 72 whose rotating movement is converted by way of a step-down gear 73 and a toothed belt drive 74 or comparable gearing devices into a linear movement which is transmitted to the carriage 69 by way of a connecting rod 75. Another servo motor 77 is connected with the carriage 68 by way of a step-down gear 78 and a toothed belt 79 as well as a connecting rod 80. In addition to the swivel movements about the transverse axes, the total of six hinges existing at the ends of the rods 53, 54, 55 can also permit swivel movements in rectangular directions thereto at least in a limited swivel range.

All driving units 61, 62, 63 are disposed on stationarily disposed machine parts or elements, such as stands, frames or the like.

Rods 83, 84, 85 are also linked to the opposite hinge unit 49 to be swivellable about several axes and are part of the control arm gearing section 50*b*. In addition to the swivel movement about a transverse axis 58, at least limited swivel movements about a vertical axis and/or a longitudinal axis are also possible.

On the other ends, the rods 83, 84, 85 are connected with driving units 86, 87, 88. These each have a carriage 92, 93, 94 which is vertically displaceably disposed on guide rails 91. The carriage 92 is driven by a servo motor 96 which is connected with the carriage 92 by way of a gearing 97 changing the rotating movement into a linear movement. Correspondingly, a servomotor 98 is connected with the carriage 93 by way of such a gearing device 99. For driving the carriage 94, a servo motor 101 is used which is connected with it by way of a gearing device 102 which converts its rotating movement into a linear movement.

Figure 5:
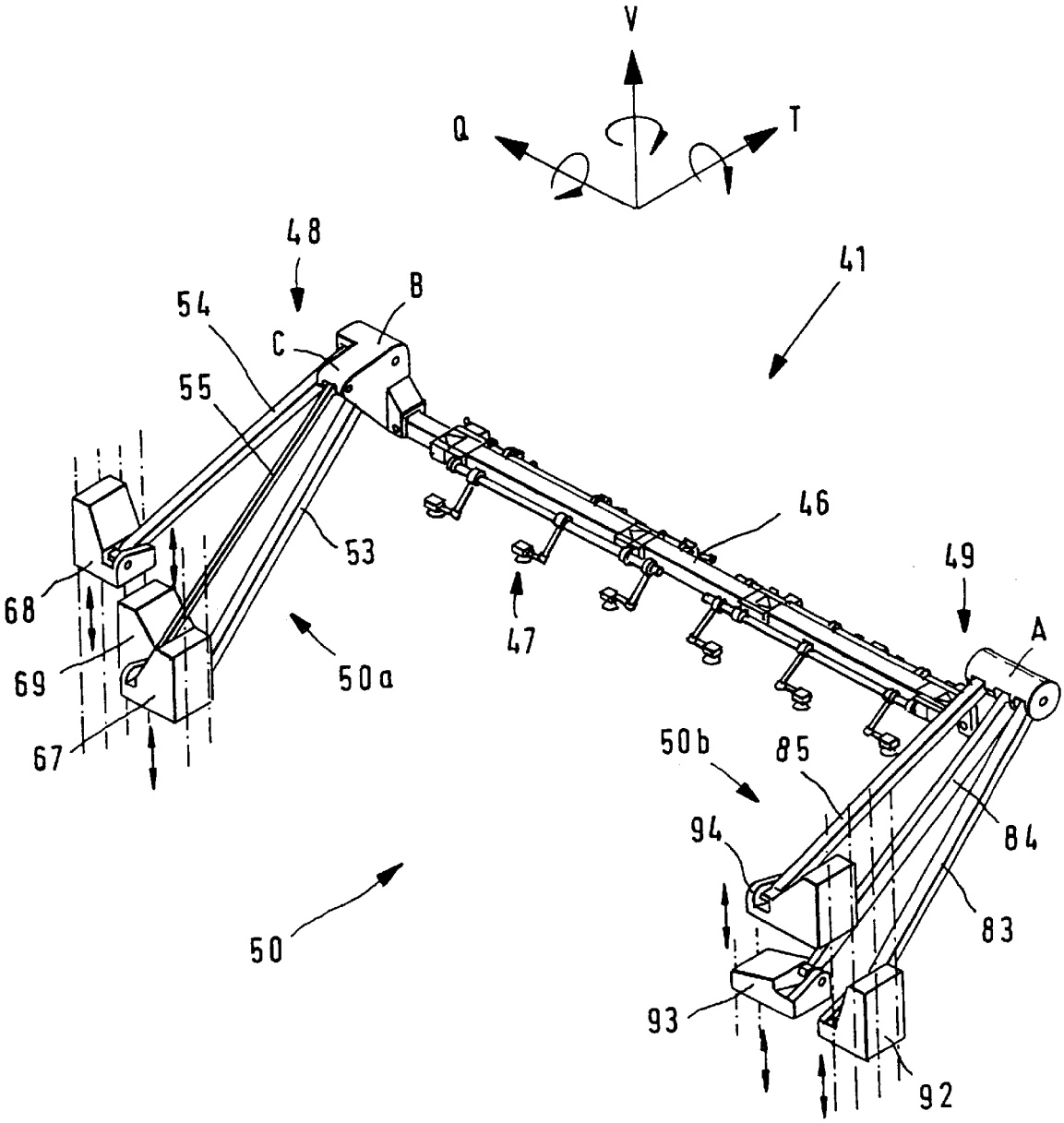
FIG. 5 is a view of the kinematics of the transfer device according to FIGS. 3 and 4.

FIG. 5 illustrates the kinematics of the transfer device 41. For example, a movement of the cross traverse 46 in the passage direction T is achieved in that the carriages 69 and 92 are moved slightly downward and the remaining carriages are moved vertically upward. The moving of the carriage 67 in the upward or the downward direction results in a rotation of the cross traverse 46 about its transverse axis. For adjusting the cross traverse in the vertical direction, all carriages 67, 68, 69; 92, 93, 94 are adjusted upward or downward. A swivelling or tilting of the cross traverse 46 about the axis defined by the passage direction T is achieved by the different adjustment of the carriages 67, 68, 69 and of the carriages 92, 93, 94. On the whole, it is illustrated that the three rods 83, 84, 85 extending in different directions in space away from the hinge unit 49 clearly determine the position of the hinge unit 49 with respect to the translational axes T, V, Q. In contrast, the struts 53, 54, 55 determine the corresponding swivel positions.

The multistation press 1 described above operates as follows.

The movement of the press slides 26 to 30 is coordinated such with one another that the slide situated downstream in the passage direction with respect to the flow of parts follows the respective preceding (arranged upstream) slide in each case by a time staggering which corresponds essentially to the time which each transfer device 41 to 44 requires in order to swivel the cross traverse 46 from one work station to the respective next work station. If, for example, the top tool starts to move upward, the servo motors 71, 72, 77; 96, 98, 101 are controlled such that the cross traverse 46 swivels into the opened tool and receives the workpiece. While the cross traverse 46 is now swivelled by corresponding controls of the servo motors 71, 72, 77; 96, 98, 101 on the transfer curve K in the direction to the next press station 3, its press slide 27 has travelled through its lower dead center and opens the tool so that, after the removal of the workpiece by the transfer device, 42, the workpiece can be inserted by the transfer device 41.

The control device which is not shown in detail controls the servo motors 71, 72, 77; 96, 98, 101 such that the desired transfer curve K is obtained. Swivel movements of the workpiece about a transverse axis or other more complicated positioning tasks can easily be carried out during the transfer. As illustrated in FIG. 5, the transfer device has six degrees of freedom. As required, the number of the degrees of freedom can be reduced, in which case the corresponding transfer device is then correspondingly simplified. In the simplest embodiment, only two linear axes are present which are each applied to the cross traverse 46 by way of pairs of rods. Thus, two-dimensional transfer curves K can be achieved.

In the case of an embodiment not shown in detail, the length of the control arm elements can be adjusted and the control arm elements are stationarily disposed by way of a hinge by means of their respective end situated away from the cross traverse. The driving units are integrated in the control arm elements.

However, it is also possible to construct the driving units such that their outputs are guided on a curved path. The drives will then, for example, be crank or eccentric drives which are operated by servo motors.

Simplified embodiments may have a reduced number of drives. For example, the rods 53 and 55 may both be disposed on the carriage 67 or 69 if no swivelling of the cross traverse is required. It is also possible to dispose the rod 83 on the carriage of the rod 84 or 85 if no adjusting is required in the transverse direction Q.

A transfer device 41 which is provided particularly for multistation presses 1 has a holding device 46, 47 which is carried by several rods 53, 54, 55; 83, 84, 85 and which can be swivelled in space and positioned by the rods 53, 54, 55; 83, 84, 85. The rods 53, 54, 55; 83, 84, 85 are preferably connected with linear driving devices 61, 62, 63; 86, 87, 88 which thus act jointly upon the holding device 46, 47. In the case of an embodiment having six degrees of positioning freedom, three of the rods 53, 54, 55; 83, 84, 85 are applied to a first hinge point 49 of the holding device 46, 47. By means of their other ends, these rods 83, 84, 85 define a rectangle. Of the remaining three rods 53, 54, 55, two 53, 54 are applied to another hinge point 56 and a third 55 is applied to a hinge point 57 which is situated away from there and which, in turn, defines a triangle together with the other two hinge points 49, 56. In addition to a simple workpiece transfer, such a transfer device 41 permits complicated positioning tasks.

We claim:

1. Transfer device for workpieces to be transported on a predetermined path, particularly for transport of workpieces along several successive work stations, comprising a holding device which configured for controllably receiving and releasing workpieces, a cross traverse which operatively carries the holding device, and a carrying device which operatively carries the cross traverse and guides the latter on a predetermined transfer curve, a driving device for driving the cross traverse in at least two mutually independent directions and having at least a first and a second driving unit independently controllable of one another, wherein the carrying device comprises a first and a second group of control rods arranged between the driving device and the cross traverse, the cross traverse being held on one end thereof by the first group of control rods connected together a the one end and which together as a unit position the one end of the cross traverse in the two directions, and the cross traverse being held on another end thereof by the second group of control connected together at the another end and which together as a unit position the another end of the cross traverse in the two directions as well as in an additional direction.

2. Transfer device according to claim 1, wherein each of the first and second groups of control rods has at least two control rods loaded predominantly with respect to push and pull, and which extend in at least two mutually different directions away from the cross traverse, a first end respectively of the control rods being connected with the cross traverse by a hinge device, and a driving unit being operatively associated with each control rod for adjustably positioning a second end of the control rod away from a first end in a targeted manner.

3. Transfer device according to claim 1, at least one group of the control rods has control rods, each being connected on a second end thereof by a hinge with the driving unit associated therewith.

4. Transfer device according to claim 1, wherein at least one group of the control rods has control rods operatively connected with the cross traverse on one end of the cross traverse at a linking point and on another end of the cross traverse on two mutually spaced linking points so that the linking points define a triangle, three of the control rods being connected at one of the linking points, two control rods being connected at another of the linking points and one control rod being connected at the remaining linking points to the cross traverse.

5. Transfer device according to claim 1, wherein the driving units are each disposed in a stationary manner.

6. Transfer device according to claim 5, wherein the driving units are linear units whose outputs carry out a defined linear movement which is a function of an input signal, and the linear units have mutually parallel working directions and are spaced away from one another transversely with respect to a working direction thereof.

7. Transfer device according to claim 6, wherein the driving units are direct electric drives.

8. Machining device for the successive machining of workpieces in several steps, particularly a suction press for machining sheet metal parts, having plural work stations arranged behind one another through which the workpieces travel in a successive manner, and having at least one transfer device comprising a holding device which configured for controllably receiving and releasing workpieces, a cross traverse which operatively carries the holding device, and a carrying device which operatively carries the cross traverse and guides the latter on a predetermined transfer curve, a driving device for driving the cross traverse in at least two mutually independent directions and having at least a first and a second driving unit independently controllable of one another, wherein the carrying device comprises first and second groups of control rods arranged between the driving device and the cross traverse, the cross traverse being held on one end thereof by the first group of control rods connected together at the one end and which together as a unit position the one end of the cross traverse in the two directions, and the cross traverse being held on another end thereof by the second group of control rods connected a the another end and which together as a unit position the another end of the cross traverse in the two directions as well as in an additional direction.

9. Machining device according to claim 8, wherein the transfer device is arranged between two successive work stations, the transfer device configured to be controllable independently of other transfer devices of the machining device.

10. Machining device according to claim 8, wherein the work stations of the machining device operate in a time-staggered manner with respect to one another.

* * * * *